US010203076B2

(12) United States Patent
Nguyen et al.

(10) Patent No.: US 10,203,076 B2
(45) Date of Patent: Feb. 12, 2019

(54) FRICTION BLADE TRIM RETENTION SYSTEM

(71) Applicant: CORDELIA LIGHTING, INC., Rancho Dominguez, CA (US)

(72) Inventors: Huan C. Nguyen, Placentia, CA (US); Aaron O'Brien, Los Alamitos, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 0 days.

(21) Appl. No.: 15/872,918

(22) Filed: Jan. 16, 2018

(65) Prior Publication Data

US 2018/0202623 A1 Jul. 19, 2018

Related U.S. Application Data

(60) Provisional application No. 62/500,435, filed on May 2, 2017, provisional application No. 62/487,459, filed on Apr. 19, 2017, provisional application No. 62/446,825, filed on Jan. 16, 2017.

(51) Int. Cl.

| | |
|---|---|
| ***F21V 17/00*** | (2006.01) |
| ***F21S 8/02*** | (2006.01) |
| ***F21V 21/26*** | (2006.01) |
| ***F21V 21/04*** | (2006.01) |

(52) U.S. Cl.

CPC ..... *F21S 8/026* (2013.01); *F21S 8/028* (2013.01); *F21V 21/041* (2013.01); *F21V 21/26* (2013.01)

(58) Field of Classification Search

CPC ..... F21V 21/041; F21V 21/26; F21S 8/026; F21S 8/028

See application file for complete search history.

(56) References Cited

U.S. PATENT DOCUMENTS

| | | | | |
|---|---|---|---|---|
| 5,836,677 | A | 11/1998 | Connors et al. | |
| 6,719,438 | B2 * | 4/2004 | Sevack | F21S 8/02 362/145 |
| 7,410,276 | B2 | 8/2008 | Fryzek et al. | |
| 7,824,080 | B2 | 11/2010 | Gibson et al. | |
| 8,096,686 | B2 | 1/2012 | Wilcox | |
| 8,794,803 | B1 | 8/2014 | Paulsel | |
| 9,039,254 | B2 | 5/2015 | Danesh | |
| 9,243,786 | B1 | 1/2016 | Onda et al. | |
| 2008/0180961 | A1 | 7/2008 | Gibson et al. | |
| 2008/0296458 | A1 | 12/2008 | Gibson et al. | |
| 2010/0246172 | A1 | 9/2010 | Liu | |
| 2010/0265725 | A1 | 10/2010 | Wilcox | |

(Continued)

FOREIGN PATENT DOCUMENTS

WO WO 2007/027175 A1 3/2007

*Primary Examiner* — Ali Alavi

(74) *Attorney, Agent, or Firm* — Paul Y. Feng; One LLP

(57) ABSTRACT

A friction blade trim retention system is disclosed. The friction blade trim retention system uses friction blades that are biased radially outward to engage the interior wall of a can housing to hold a trim assembly of a recessed light fixture therein. The system includes vertical translating components that include spring biased detents to toggle between an upper position and a lower position. The detent lower position allows the installer to install the friction blade inside the can in a first step. The installer in the second step pushes the trim assembly upward into the can to engage the upper detent, thus completing installation.

16 Claims, 8 Drawing Sheets

(56) References Cited

U.S. PATENT DOCUMENTS

| | | | |
|---|---|---|---|
| 2014/0254177 | A1 | 9/2014 | Danesh |
| 2014/0268801 | A1 | 9/2014 | Madden et al. |
| 2015/0043210 | A1 | 2/2015 | Liu et al. |
| 2016/0091182 | A1 | 3/2016 | Bardot et al. |

* cited by examiner

SECTION C-C 10
12
14
16
18
20
22
24
28
30(a)
30(b)
32
34
36
38
40
42
44
46

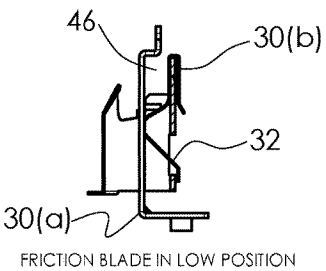
FRICTION BLADE IN LOW POSITION
FIG.9(b)
FIG.9
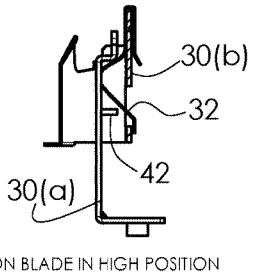
FRICTION BLADE IN HIGH POSITION
FIG.9(a)
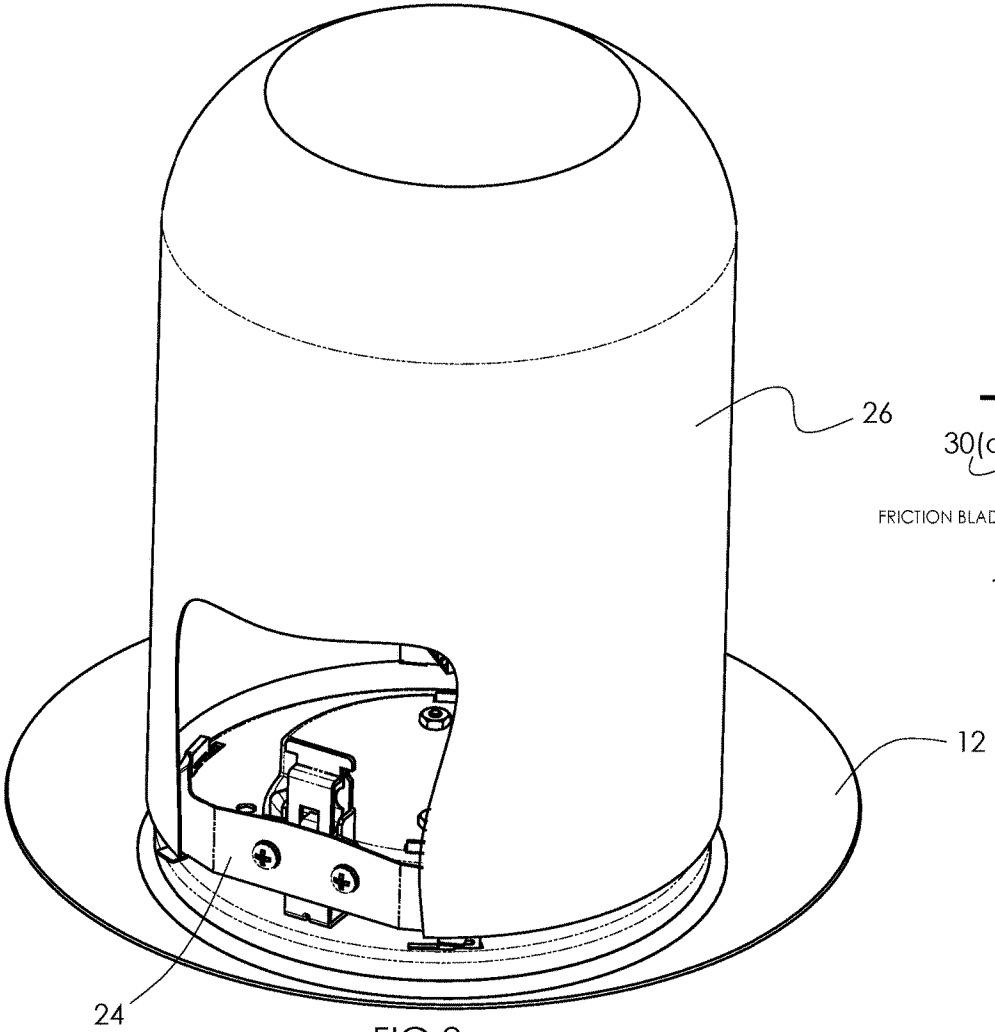
FIG.8

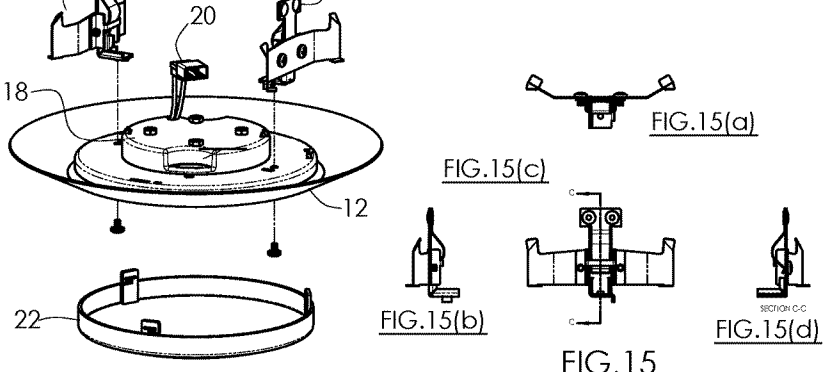
FIG.15(a)
FIG.15(c)
FIG.15(b)
FIG.15(d)
SECTION C-C
FIG.15
FIG.13
50
20
18
12
22
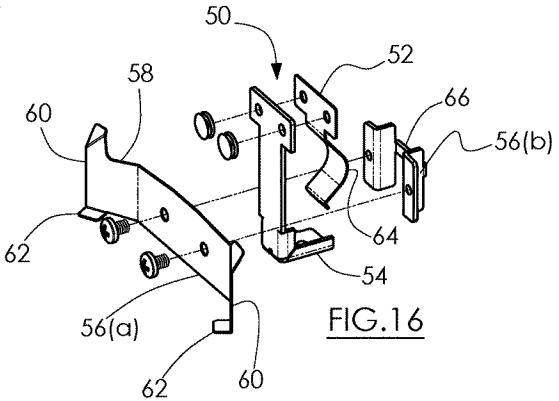
56(b)
66
52
64
54
50
60
58
62
56(a)
FIG.16
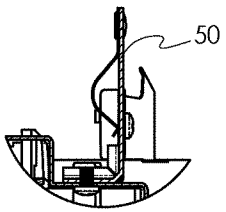
50
FIG.14
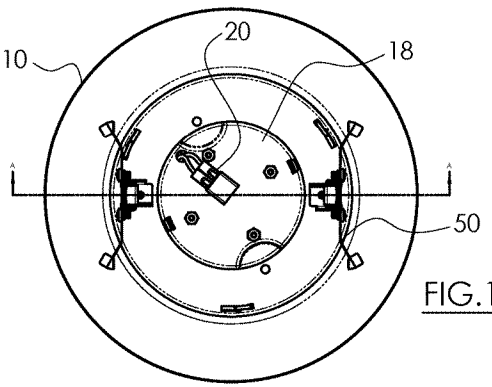
18
50
20
10
FIG.10
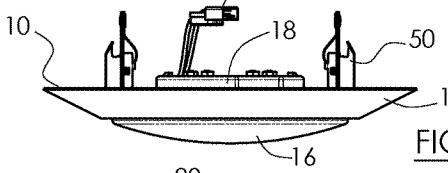
50
12
18
16
20
10
FIG.11
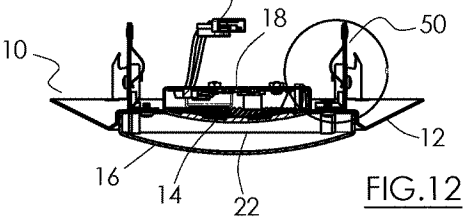
50
12
18
22
20
14
16
10
FIG.12

FRICTION BLADE IN LOW POSITION

FRICTION BLADE IN HIGH POSITION

FIG.26(a)
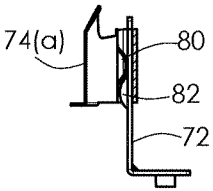
FRICTION BLADE IN HIGH POSITION
FIG.26(b)
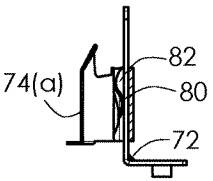
FRICTION BLADE IN LOW POSITION
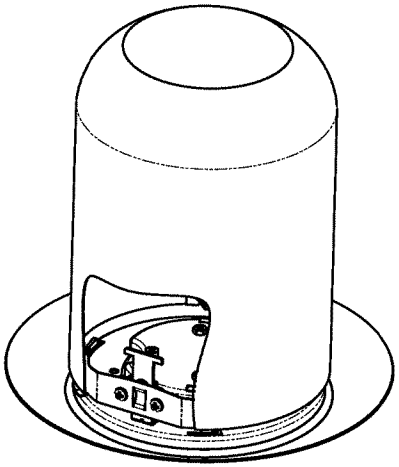
FIG.28
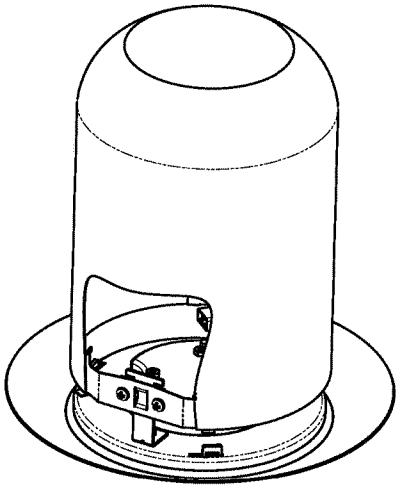
FIG.29
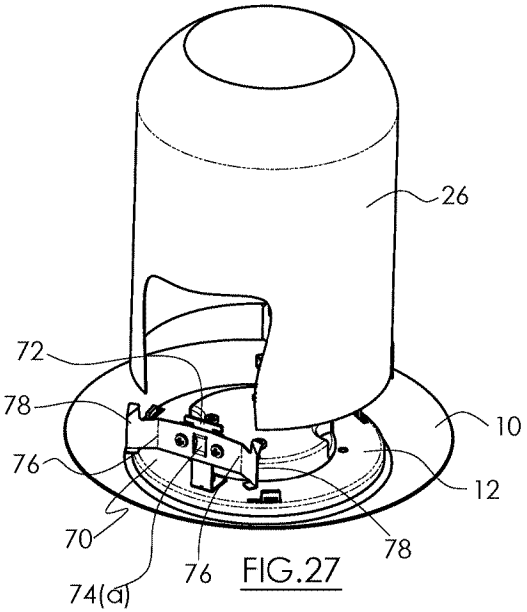
FIG.27

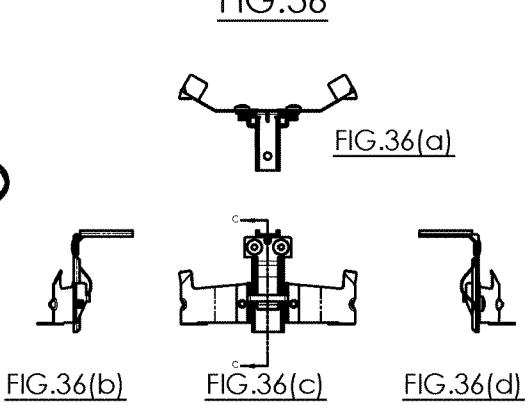
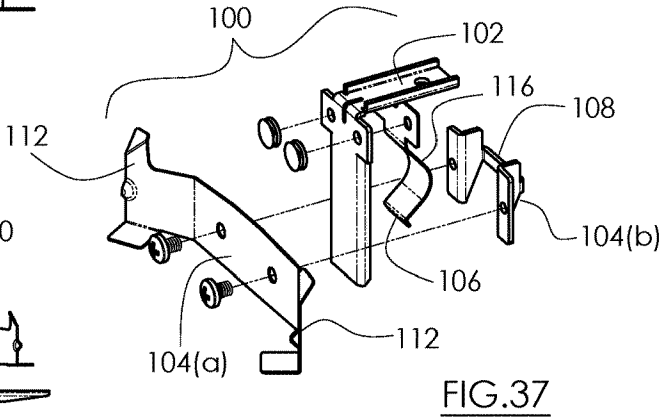
FIG.37
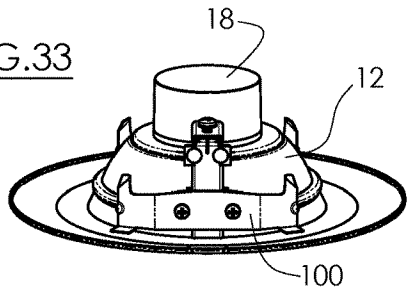
FIG.33
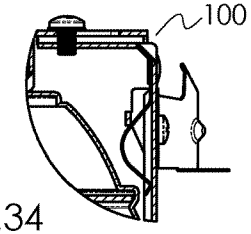
FIG.34
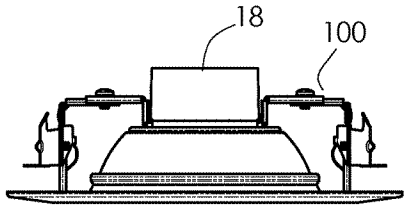
FIG.35
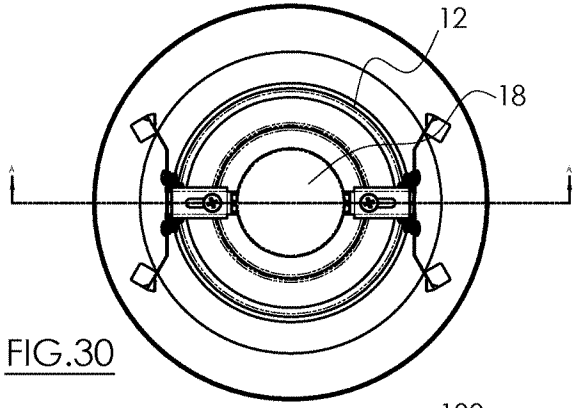
FIG.30
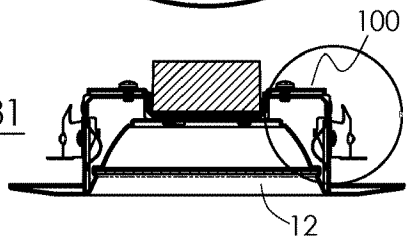
FIG.31
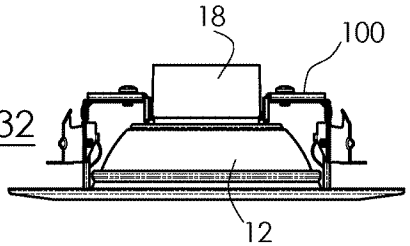
FIG.32

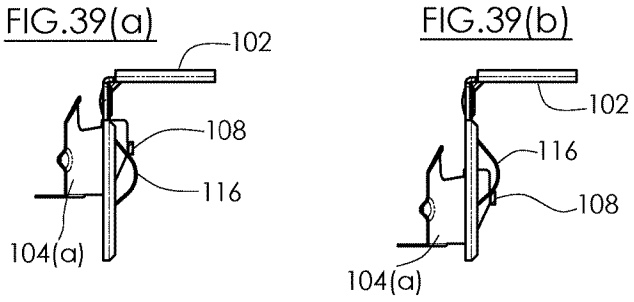
FIG.39(a)
FRICTION BLADE IN HIGH POSITION
FIG.39(b)
FRICTION BLADE IN LOW POSITION
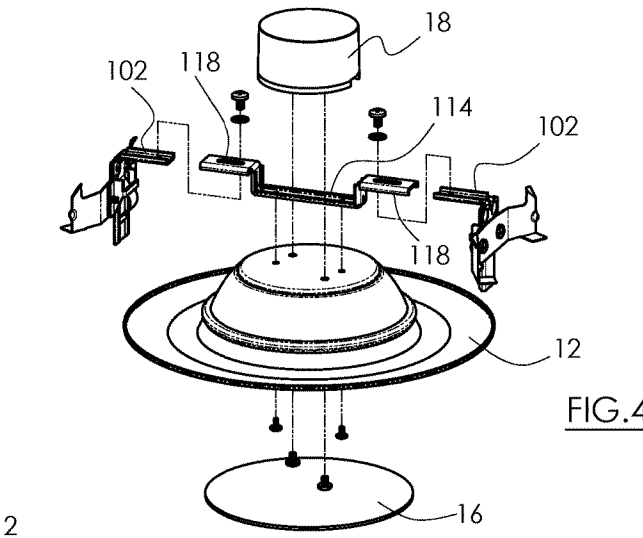
FIG.40
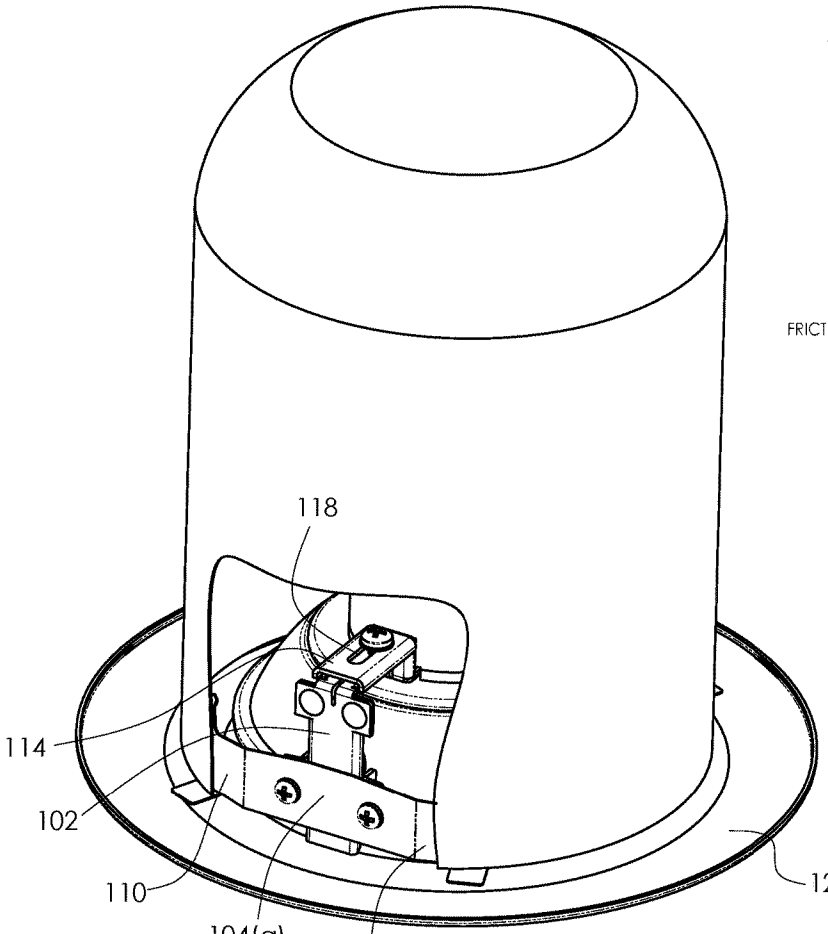
FIG.38

FRICTION BLADE TRIM RETENTION SYSTEM

CROSS-REFERENCE TO RELATED APPLICATIONS

This application claims priority from provisional application No. 62/446,825, filed Jan. 16, 2017; app. no. 62/487,459 filed Apr. 19, 2017; and app. no. 62/500,435 filed May 2, 2017, the contents of all of which are hereby incorporated by reference.

FIELD OF THE INVENTION

The present invention relates to residential and commercial light fixtures. In particular, the present invention relates to hardware used in ceiling light fixtures or similar luminaires.

BACKGROUND OF THE INVENTION

Recessed light fixtures are commonplace in residential homes and commercial buildings. A recessed light fixture typically has a metal housing or can, an electrical junction box, and a conical-shaped recessed trim assembly to direct and reflect the lighting emitted by a bulb (or similar light source) that is held inside by a bulb holder or socket. The can and junction box are supported on a pan. The can and pan assembly are installed above the ceiling of a building or house so that the opening in the can and the trim are flush with the ceiling. The light fixture is thus recessed into the ceiling. The light source inside the trim assembly can be an incandescent or halogen bulb, a compact fluorescent tube (CFL), an LED or the like.

A decorative trim ring is often attached to the trim assembly of the light fixture facing the floor, exposed to the living space beneath the fixture. The trim ring provides a finished look for the light fixture.

The can, trim assembly, junction box and pan are suspended by a pair of hanger bars extending parallel and on opposite sides of the pan. One type of standard ceiling is supported by joists, and the recessed light fixture is mounted onto the joists via the hanger bars. When the joists are made of wood or concrete, for example, the hanger bars are usually mounted to the joists with nails, screws or other standard mounting means. The weight of the light fixture is thereby supported by the joists through the hanger bars.

Alternatively, the ceiling may be of the "drop-down" or suspended type. A drop-down ceiling is a secondary ceiling often formed to conceal piping, wiring, HVAC, and/or the floor above. The drop-down ceiling typically consists of a grid-work of metal channels in the shape of an upside-down "T" (i.e., T-bar grid), suspended on wires from an overhead structure. The channels snap together in a regularly spaced pattern, and the resulting cells are filled with lightweight "acoustic ceiling tiles" or "panels" dropped into the grid. Light fixtures may be installed into the grid as desired.

SUMMARY OF THE INVENTION

The present invention in a preferred embodiment is directed to a recessed lighting trim retention system for supporting a light fixture inside a can housing. There are preferably at least two friction blade trim attachments. Each trim attachment has a first stationary portion having a horizontally elongated shape with resilient spring arms at opposite ends, wherein each spring arm terminates in a friction blade having an edge for engaging an interior of the can; and a second stationary portion including a channel formation joined to the first stationary portion, wherein the channel forms a vertical space between the first and second stationary portions. Each trim attachment further includes an elongated L-shaped mounting bracket translating vertically relative to the first stationary portion within the vertical space, wherein the mounting bracket includes a spring biased toggle means facing the vertical space. The elongated mounting bracket is attached to the light fixture. A complementary toggle means facing the spring biased toggle means is disposed on or integrated into the elongated mounting bracket or the second stationary portion. In operation, the spring biased toggle means and the complementary toggle means selectively engage each other to bias the elongated mounting bracket into either an up position or a down position of the light fixture relative to the can. The spring biased toggle means is preferably a bar spring having a peak or hump, and the complementary toggle means is preferably a protrusion, ridge, cross-member, or the like.

BRIEF DESCRIPTION OF THE DRAWINGS

FIG. 8 is a partial cutaway view of the friction blade retention system as implemented inside a can housing.

FIG. 9 including FIGS. 9(*a*) and 9(*b*) show the friction blade retention system in the high and low positions.

FIG. 10 is a top plan view of an alternative embodiment friction blade trim retention system.

FIG. 11 is a side elevational view of the embodiment in FIG. 10.

FIG. 12 is a cross-sectional view.

FIG. 13 is an exploded view.

FIG. 14 is a magnified view of the encircled area in FIG. 12.

FIG. 15 including FIG. 15(*a*)-(*d*), respectively, are a top plan view, a left side view, a front elevational view, and a right side view.

FIG. 16 is an exploded perspective view.

FIGS. 26(*a*) and 26(*b*) are cross-sectional views of the friction blade trim retention system in a down position and an up position.

FIGS. 27-29 show, respectively, the various stages (i.e., down, middle and up positions) for installing the light fixture and friction blade trim retention system inside a can housing.

FIG. 30 in a top plan view shows still another alternative embodiment friction blade trim retention system applied to a trim assembly of a recessed light fixture.

FIG. 31 is a cross-sectional view of FIG. 30.

FIG. 32 is a side elevational view of the FIG. 30 embodiment.

FIG. 33 is a top perspective view of the FIG. 30 embodiment.

FIG. 34 is an enlarged detail view of the encircled area in FIG. 31.

FIG. 35 is another side elevational view.

FIG. 36 including FIGS. 36(*a*)-36(*d*), respectively, are a top, left side, front elevation, and right side views.

FIG. 37 is an exploded perspective view of that alternative embodiment.

FIG. 38 shows the alternative embodiment friction blade trim retention system with trim assembly installed inside a can housing.

FIGS. 39(*a*) and 39(*b*) show the down and up detent positions of the friction blade spring retention system.

FIG. 40 depicts how the friction blade trim attachment is assembled to the trim assembly.

DETAILED DESCRIPTION OF THE PREFERRED EMBODIMENTS

Figures 1, 2, 3, 4, 5, 6, 6A, 6B, 6C, 6D, 7:
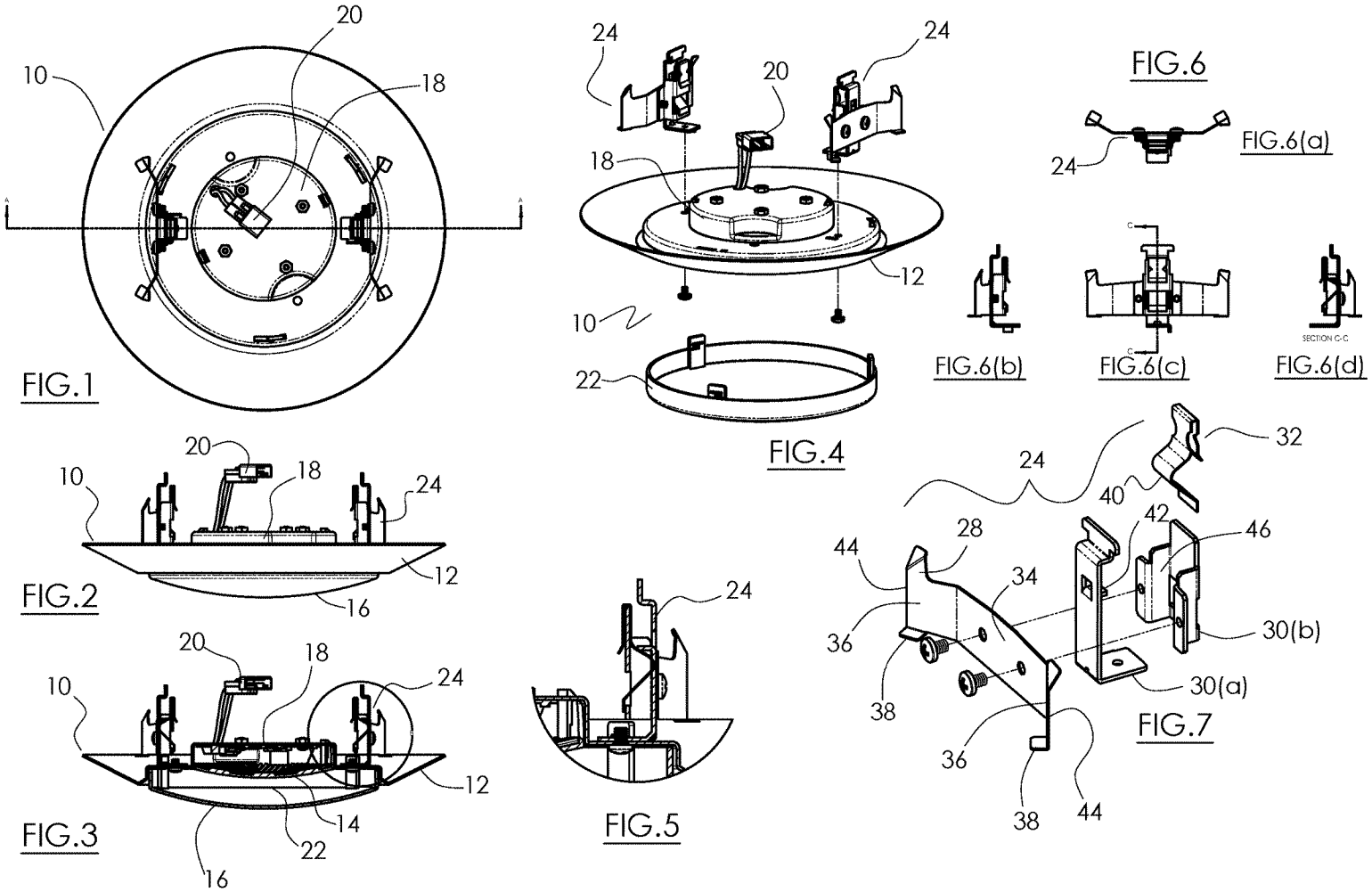
FIG. 1 is a top plan view of a light fixture using a preferred embodiment friction blade trim retention system.
FIG. 2 is a side elevational view.
FIG. 3 is a cross-sectional view.
FIG. 4 is an exploded view.
FIG. 5 is a magnified detail view of the encircled area in FIG. 3.
FIG. 6 including FIGS. 6(*a*)-6(*d*) are, respectively, a top plan view, a left side view, a front elevational view, and a right side elevational view of the friction blade mechanism.
FIG. 7 is an exploded perspective view of the fiction blade retention system.
Figure 18B:
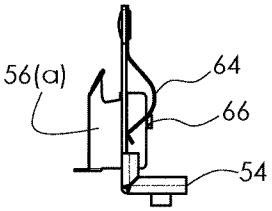
FIGS. 18(*a*) and 18(*b*) show the friction blade retention system in a down position and an up position.
Figure 18A:
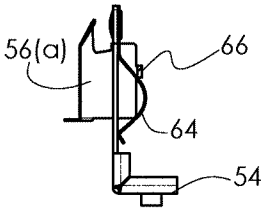

The present invention is directed to a mounting system to be used primarily with a trim or trim assembly to be installed in a recessed light fixture. The present invention is novel, at least because it uses friction and compression forces to hold an assembly/trim in a recessed housing or "can," and a compression force again to keep the assembly/trim in contact with the finished ceiling or wall. In a preferred embodiment, this dual compression feature is self-contained on the trim assembly. The trim may also include a feature which limits how far the portion of the compression structure that interfaces with the fixture side wall can slide into the recessed housing or can. Pre-existing recessed housing structures can work with the present invention and the trim/assembly will hold tight against the ceiling or wall.

Conventional trim retention systems/mechanisms hold a trim or trim assembly within a recessed light fixture via torsion springs, friction blades, screws, etc. Friction blades are resilient arms that are compressed within a recessed fixture against the interior of the light fixture or can, and the friction between the fixture and the sharp edges of the blades prevent the trim/assembly from falling out of the fixture from gravity. These conventional mechanisms do not have a solid engagement snap, click, or detent lock, so the heavy trim may slip or fall out of the can over time due to ceiling vibrations and gravity.

Conventional torsion springs mounted on the trim or in the housing are compression springs which are installed in a manner that the springs stay in the compressed position within a bracket and slowly pop open within the bracket to pull the trim/assembly tight to the finished ceiling/wall and hold the trim/assembly within the fixture. This is a common and known method of mounting the trim for most housings with apertures greater than a 4-inch diameter. For housings with smaller apertures, friction blades alone have been used for most trims/assemblies.

Another conventional retention mechanism uses coiled tension springs to hold the trim assembly inside the can. The opposite ends of the tension springs are hooked to the can and the trim assembly, so the stretched springs bias the two structures together.

Some trim or trim assemblies are held by friction alone and others mate with an internal structure to allow compression between the spring and the internal structure along with compression to the side wall of the recessed fixture.

Those trim or trim assembly retention systems which use fasteners known in the art require the consumer to use tools for installation, which is an inconvenience for the consumer. The fasteners are usually hidden in the upper portion of the trim assembly to improve aesthetics, but this limits access by the consumer during the installation process.

Single compression torsion springs lack the ability to pull the trim/assembly in tight or snug contact with the ceiling/wall. The compression of the springs happens in a lateral/horizontal fashion between the housing sidewall and the vertical section of the trim/assembly. There is no other action to help prevent a gap forming between the ceiling/wall and the trim/assembly. Most installations which feature this form of retention have some gap between the ceiling/wall. The gap is visible with the naked eye to the room's occupants, so it is highly undesirable.

Creating trim/assemblies to replace trim/assemblies in housings which have been installed creates challenges to using only the known retention mechanisms. Housings must be made to accept the dual compression springs or torsion springs. Those housings which have no means to accept these springs will be need a single compression, friction spring to squeeze against the housing sidewalls. This will hold the trim/assembly into the can or housing, but it will not pull it tight.

According to a preferred embodiment of the present invention depicted in FIGS. 1-9, the dual compression action is a function of the relationship between the trim and the recessed housing, designed to engage the friction spring in a manner that creates compression in two areas. The present invention structure is ideal since it preferably uses a dedicated trim and housing to work in unison.

From an economics perspective, the present invention helps suppliers who sell both the trim and housing complete the sale without the consumer using an alternate trim/assembly in the housing sold to mount in the ceiling. The dual compression also pulls the trim/assembly close to the ceiling/wall for a finished look with a tight fit.

The present invention in a preferred embodiment has a dual compression feature built into the trim assembly. The trim assembly has a spring that is installed in two motions. First, the assembly has a structure that allows the spring to be in compression and fixed in the housing for the initial portion of the installation process; and second, the trim assembly is pushed toward the housing aperture which activates the second compression or detent mode. The trim assembly is designed to compress the spring and pull the trim tight to the housing or can aperture.

FIGS. 1 and 2 are top and side elevational views, respectively, of a typical light fixture 10 having a circular or disk shape. Other shapes, such as a square, are contemplated. The light fixture 10 includes a trim assembly 12 having preferably a pan shape. The trim assembly interior contains a light source such as, in this embodiment, LEDs 14, facing downward as seen in the cross-sectional view of FIG. 3. Optionally covering the LEDs 14 is a dome-shaped diffuser or lens 16, which can be transparent, or translucent, and may have exterior surface texture and/or a color tint. Surrounding the LEDs 14 is an optional light reflector 22 having an annular shape with reflective coating covering its ID. The reflector 22 is intended to evenly redirect and reflect the LED emitted light through the dome lens 16 and minimize dark spots seen through the lens 16.

On the back side of the LEDs 14 and mounted to the trim assembly 12 is an LED driver 18 powering the LEDs 14, with an electrical quick-connect 20. The quick-connect 20 is known in the art and can be purchased off-the-shelf from various vendors. It connects the light fixture to a pre-existing quick-connect leading to the house or building's standard AC power supply (not shown).

FIG. 4 is an exploded view of the trim assembly 12 with the reflector 22 disassembled from the bottom and two friction blade trim retention attachments 24. There are preferably two friction blade trim retention attachments 24, mounted diametrically apart to the top of the trim assembly 12. The attachments 24 are intended to engage the interior curved wall of a standard recessed light fixture housing or can 26, as seen in partial cutaway view of FIG. 8.

FIGS. 6(*a*)-(*d*) are top, left side, front and right side elevational views of a preferred embodiment friction blade trim retention attachment 24. FIG. 7 is an exploded view of a preferred embodiment friction blade trim retention attachment 24. The attachment 24 includes an elongated, rectangular shaped friction blade 28 attached to a bracket 30 with two screws, rivets, spot welds, or the like, at a central stationary portion 34. The blade 28 is made from preferably a steel flat spring or the like. Each blade 28 preferably has a sharp edge 44 to generate maximum friction and grip when pressing against the interior wall of the can 26. As seen in FIG. 7, the blades 28 extend horizontally from the central stationary portion 34 via two opposed spring arms 36 that have spring bias. At the bottom of each blade 28 is an optional tab 38 located at the bottom. The spring arms 36 and blades 28 are the first spring component of the present invention.

As seen in FIG. 7, there is a vertical space 46 created in between the central stationary portion 34 and the rear stationary portion 30(*b*), which preferably has a channel form to create the vertical space 46. That vertical space is occupied by a V-spring 32 which itself is hooked to rear stationary portion 30(*b*). The V-spring 32 is a bar spring and has a resilient peak or hump 40, making the V-spring 32 the second spring component of the present embodiment. As such, the V-spring 32 is optionally entirely made from spring steel and has a spring bias to retain its V-shape with the hump. FIGS. 6(*a*)-6(*d*) show the components of the attachment 24 assembled. The two spring components 28, 32, use bar springs, but coiled springs, torsion springs and their equivalents may be added or substituted for the bar spring.

FIG. 9 is a cross-sectional view showing the rear stationary portion 30(*b*) attached to the center stationary portion 34 creating a vertical space therebetween, with the V-spring 32 translating up and down within that vertical space. That is, the center stationary portion 34 is assembled to the rear stationary portion 30(*b*) via the two machine screws so the two pieces move in unison, while the L-shaped mounting bracket 30(*a*) is attached to the trim assembly 12, so the two parts 30(*a*), 30(*b*) freely translate up and down relative to each other. When in use, the friction blade 28 of the center stationary portion 34 engages the interior wall of the can 26, while the mounting bracket 30(*a*), which is attached to the light fixture 10, can slidably translate the fixture 10 into the can 26 by moving from its position in FIG. 9(*a*) to FIG. 9(*b*).

As seen in FIG. 7, a rigid finger 42 or like raised protrusion on the mounting bracket 30(*a*) extends into the vertical space, and selectively engages, depresses, and slides over the hump 40 of the V-spring 32 to create a toggle or detent action. This vertical toggle action is depicted in FIGS. 9(*a*) and 9(*b*). Thus, as the mounting bracket 30(*a*) is pushed upwards by an installer (to install the trim assembly, FIG. 9(*a*)), the finger 42 partially deflects V-spring 32 as the finger moves upward toward the hump 40, and once the finger 42 deflects and slides over hump 40, the V-spring 32 resiliently returns to its original V-shape, forcing the finger 42 to slide down the opposite side of the hump 40, as seen in FIG. 9(*b*). The resilience in the V-spring 32 thus biases the mounting bracket 30(*a*) and attached trim assembly 12 upward once the finger 42 slides past the peak in the hump 32 into its detent position. This upward bias essentially pulls the trim assembly 12 upward into the can 26, as perceived by the installer, ending with the installed state shown in FIG. 8.

FIG. 8 shows the attachment 24 with the trim assembly 12 installed inside the recessed light fixture can 26. The attachments 24 are used to retain the trim assembly 12/light fixture 10 to the can 26. In the first step of installation, spring arms 36 are seen deflected and pushed against their bias to conform to the ID of the can; the surfaces of the spring arms 36 thus frictionally engage the interior wall of the can 26 to hold the friction blade 28 and bracket stationary portion 30(*b*) in place, relative to the can 26, as seen in FIG. 9(*a*).

In the next step, the installer simply pushes up on the trim assembly 12 to overcome the resistance from the finger 42 engaging the hump 32, and once the finger 42 passes over the hump 32, the resilience in the V-spring restoring to its un-deflected state drives the finger 42 upward, and thus pulling the trim assembly 12 into the can 26. The stopper tabs 38 at the bottom of the friction blade 28 engage the underside lip of the can 26 and act as stops to prevent overtravel in the upward direction. The installation is now complete.

Disassembly of the trim assembly 12 from the can 26 only requires the installer to tug downward on the trim assembly 12 to overcome the spring bias of the finger 42 moving downward over the hump 40 of the V-spring 32, and to continue tugging to overcome the friction of the spring arms 36 against the ID wall of the can 26. Continued downward tugging fully detaches the trim assembly 12 from the can 26.

FIGS. 10-18 depict an alternative embodiment with a slightly different arrangement of the V-spring and bracket halves from the embodiment disclosed above. In this embodiment, the V-spring is attached to the sliding portion, and during the sliding motion, the V-spring hump selectively toggles into detent openings (corresponding to a high position and a low position) in the stationary portion of the bracket.

FIGS. 10-14 show the alternative embodiment friction blade trim attachment 50 installed on a trim assembly 12/light fixture 10 already described above. FIGS. 15(*a*)-(*d*) are top, left side, front and right side elevational views of the alternative embodiment friction blade trim retention attachment 50. FIG. 16 is an exploded view of the alternative embodiment friction blade trim attachment 50. The operation again uses a stationary component engaging the interior of the can by friction and spring bias and a sliding moving portion attached to the trim assembly to raise it into the can or lower it out of the can with positive engagement clicks or detents. Specifically, FIG. 16 shows the stationary portion halves 56(*a*) and 56(*b*), joined together by screws, rivets, tack welds, roll pins, or equivalent fastener. Sandwiched therebetween 56(*a*) and 56(*b*) is the movable mounting bracket 54. The mounting bracket 54 preferably has an "L" shape with an optional tab at the bottom for attachment to the trim assembly 12 as seen in FIG. 12. Joined to the mounting bracket 54 is the V-spring 52, and it translates up and down with the mounting bracket 54 relative to the stationary portion 56(*a*), 56(*b*).

Stationary portion 56(*a*) features spring arms 58 that have resilience and are made from spring steel or like material. At the distal ends of the spring arms 58 are friction blades 60 that scrape along the interior of the can 26 from installation to final rest position. The spring arms 58 have a radially outward spring bias when installed inside the can 26 to create a radially outward force that holds the weight of the trim assembly 12 inside the can 26 against the force of gravity and any movement from ceiling vibrations. Furthermore, the friction blades 60 have a sharp edge that creates high frictional forces as they engage the interior wall of the can 26. The friction blades 60 further supplement holding the attachment assembly 50 immobile inside the can 26. The optional stopper tab 62 engages the bottom lip of the can opening so the installer knows that the attachment assembly 50 has been pushed as far up as possible inside the can 26, as seen in FIG. 17.

In this embodiment, the V-spring 52 is also made from a spring steel, preferably, but plastic spring parts, or torsion and coiled spring parts are contemplated. The V-spring 52 has a hump 64 that selectively engages a cross-member 66 formed into stationary portion 66, which looks like an "H." Thus, when the V-spring 52 moves up and down relative to the stationary portion 66, the hump 64 slides up and down over the cross-member 66, so the open areas above the below the cross-member 66 serve as detents for the hump 64 to toggle into the up and down positions. These up and down positions of the mounting bracket 54 relative to the stationary portion 56(*a*) are shown in the cross-sectional views of FIGS. 18(*a*) and 18(*b*). In those positions, the hump 64 is either snapped into the opening above (in FIG. 18(*b*)) or below (FIG. 18(*a*)) the cross-member 66. The hump 64 as mentioned above is resilient and with its sloped sides has a tendency to fall into a detent or toggle position above or below the cross-member 66.

Figure 17:
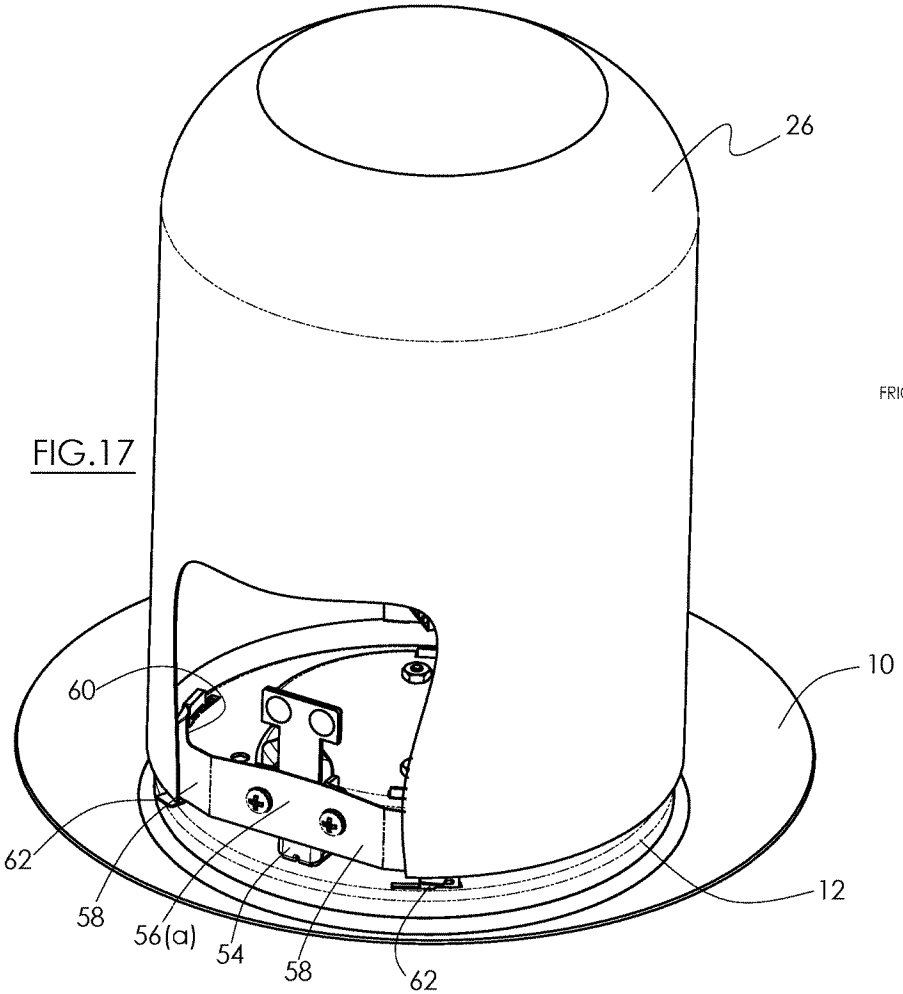
FIG. 17 shows the alternative embodiment friction blade trim retention system with light fixture installed inside a can.
Figure 19:
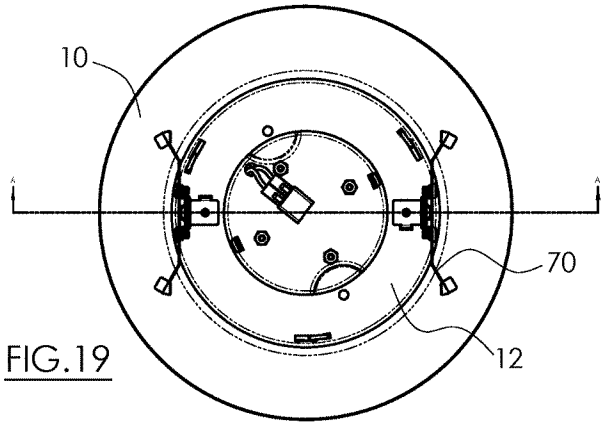
FIG. 19 is a top plan view of another alternative embodiment friction blade trim retention system as applied to a light fixture.
Figure 20:
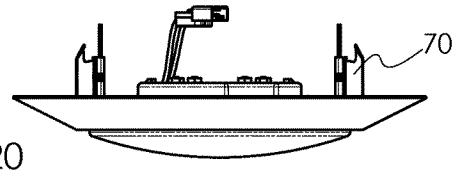
FIG. 20 is a slide elevational view of the fixture from FIG. 19.
Figure 21:
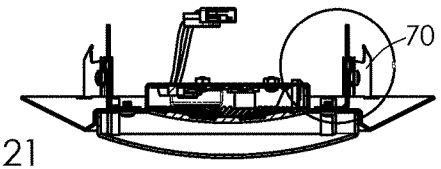
FIG. 21 is a cross-sectional view.
Figure 22:
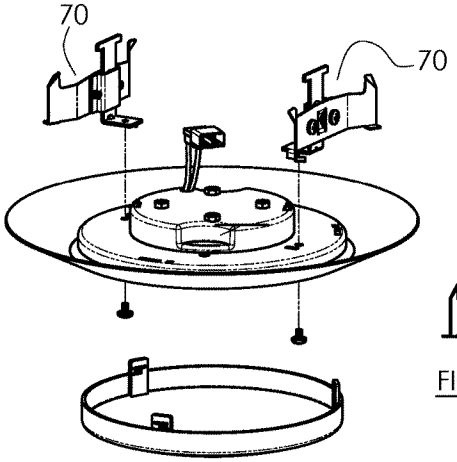
FIG. 22 is an exploded view.
Figure 23:
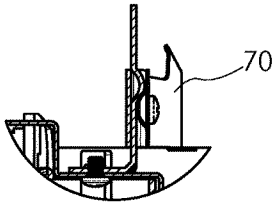
FIG. 23 is a magnified view of the encircled area in FIG. 21.

FIG. 17 shows the friction blade trim attachment 50 with light fixture 10/trim assembly 12 installed inside a can 26. The spring arms 58 have been deflected back, installed in the can, and released under spring bias to push the friction blades 60 against the can interior. The optional stopper tabs 62 abut the bottom lip of the can opening to ensure the attachment system 50 is installed fully up into the can. The mounting bracket 54 is shown partially moving toward its fully up position relative to the stationary portions 56(*a*), 56(*b*). This is why there is still a small gap between the bottom lip of the can opening and the trim assembly 12. Once the light fixture 10 and trim assembly 12 are pushed up further, and the hump 64 falls into the detent above the cross-member 66 (FIG. 18(*b*)), the gap will be closed so that the light fixture snaps tightly into position against the lip of the can opening.

Figure 24:
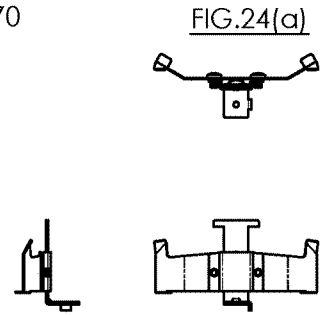
FIG. 24 including FIGS. 24(*a*)-24(*c*), respectively, are a top, left side and front elevation view.
Figure 25:
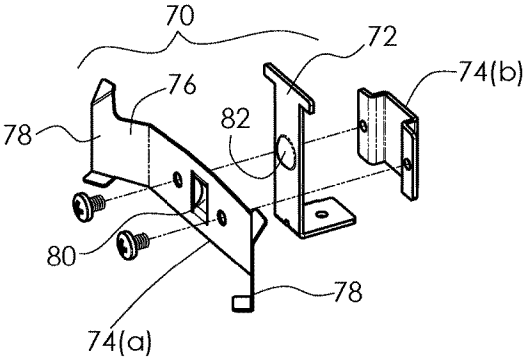
FIG. 25 is an exploded perspective view of the friction blade trim retention system.

FIGS. 19-24 show another alternative embodiment friction blade trim attachment 70 installed on a trim assembly 12/light fixture 10 already described above. FIGS. 24(*a*)-(*c*) are top, left side, and front elevational views of the alternative embodiment friction blade trim retention attachment 70. FIG. 25 is an exploded view of the alternative embodiment friction blade attachment 70. In this embodiment, the stationary portions 74(*a*) and 74(*b*) sandwich the moving, preferably L-shaped mounting bracket 72 therebetween. The stationary portion 74(*a*) includes a raised hump 80, and it slides over raised ridge 82. The movement of the ridge 82 relative to the hump 80 whether above it or below it creates the detent or toggle effect. This is illustrated in the cross-sectional view of FIG. 26(*a*) with the ridge 82 beneath the hump 80, and in FIG. 26(*b*) with the ridge 82 above the hump 80. These positions correspond to the mounting bracket 72 being in the lowered position of FIG. 26(*a*), and the raised position with the light fixture installed inside the can in FIG. 26(*b*). No V-spring is needed in this embodiment so the part is omitted.

FIG. 27 shows the friction blade trim attachment 70 mounted to the light fixture 10/trim assembly 12 via the mounting bracket 72 right before installation to the can 26. The spring arms 76 have not yet been deflected and are in the rest position. The mounting bracket 72 is in the lowered position relative to the stationary portions 74(*a*), 74(*b*). FIG. 28 shows the spring arms 76 being deflected back by the installer and inserted into the can 26, then released to bias the friction blades 78 against the interior wall of the can. The mounting bracket 72 is still in the down position. In FIG. 29, the installer has pushed the light fixture upward thus moving the mounting bracket 72 and sliding the hump 80 over the ridge 82 and snapping into position, as in FIG. 26(*b*). Installation is now complete, where the light fixture 10/trim assembly 12 fits snugly against the lip of the can. Removal only requires the installer reversing the above steps, i.e., tugging downward on the light fixture 10 to slide the ridge 82 downward over the hump 80. This pulls the trim assembly 12 from the interior of the can.

FIGS. 30-35 show still another alternative embodiment friction blade trim attachment 100 installed on a trim assembly 12 (or light fixture) already described above. FIGS. 36(*a*)-(*d*) are top, left side, front and right side elevational views of the alternative embodiment friction blade trim retention attachment 100. FIG. 37 is an exploded view of the alternative embodiment friction blade trim retention attachment 100. In this embodiment, the L-shaped mounting bracket 102 is again sandwiched in between the two halves of the stationary portion 104(*a*) and 104(*b*). A V-spring 106 is mounted to the mounting bracket 102 and the two components move in unison. As seen in the exploded view of FIG. 40, the mounting brackets 102 are assembled to a center bracket 114 which itself is disposed underneath the LED driver 18. The center bracket 114 preferably includes slots 118 to receive fasteners therein to attach to the L-shaped mounting brackets 102. The slots 118 allow the friction blade trim retention attachment 100 to mount to different dimeter sized trim assemblies. Moreover, this arrangement with the center bracket 114 fully integrates the friction blade trim retention system with the trim assembly 12. This arrangement further accommodates larger diameter and greater height-dimensioned trim assemblies.

FIG. 37 shows the two halves of the stationary portions 104(*a*), 104(*b*) screwed together, but they may be riveted, spot welded, or assembled by other known techniques, or even formed as a single piece. For example, the parts 104(*a*), 104(*b*) may be molded from plastic and formed as a single piece. Stationary portion 104(*a*) includes spring arms 110 with friction blades 112 at their respective distal ends. Preferably, at least the spring arms contain spring bias and are preferably made for spring steel or the like. Stationary portion 104(*b*) has an "H" configuration, so that there is a cross-member 108. As the hump 116 of the V-spring 106 slides above or below the open areas of the cross-member 108, an upper detent and a lower detent are created, respectively. This detent or toggling effect is illustrated in the cross-sectional views of FIGS. 39(*a*) and 39(*b*). FIG. 39(*a*) shows the cross-member 108 located above the hump 116, which corresponds to the lowered position of the hump 116 and mounting bracket 102, and the lowered position of the trim assembly 12. FIG. 39(*b*) shows the hump 116 and mounting bracket translated above the cross-member 108, which corresponds to the raised position of the mounting bracket 102 and installed position of the trim assembly 12 inside the can 26, shown in FIG. 38.

The preferred embodiments replace conventional torsion springs because they will work with housings with or without dedicated features to interface with the torsion springs. Further, the holding power to retain the trim assembly snugly to the can is much improved by using friction and radial spring bias. This holding power resists gravity's pull over time and ceiling vibrations that might eventually overcome the slowly weakening spring stiffness in a conventional torsion spring.

While particular forms of the invention have been illustrated and described, it will be apparent that various modifications can be made without departing from the spirit and scope of the invention. It is contemplated that components from one embodiment may be combined with components from another embodiment.

What is claimed is:

1. A recessed lighting trim retention system for supporting a light fixture inside a can, comprising:

a first stationary portion having a horizontal elongated shape with resilient spring arms at opposite ends, wherein each spring arm terminates in a friction blade having an edge for engaging an interior of the can;

a second stationary portion disposed on the first stationary portion to form a vertical space therebetween;

an elongated mounting bracket sliding vertically relative to the first stationary portion within the vertical space, wherein the elongated mounting bracket includes a first complementary toggle means facing the vertical space, the elongated mounting bracket attached to the light fixture;

a second complementary toggle means facing the first complementary mounting means, wherein the second complementary toggle means is disposed on one of the elongated mounting bracket and the second stationary portion; and wherein the first and second complementary toggle means selectively engage each other to bias the elongated mounting bracket into one of an up position and a down position of the light fixture relative to the can.

2. The recessed lighting trim retention system of claim 1, wherein the first complementary toggle means includes a finger protrusion and the second complementary toggle means includes a V-spring.

3. The recessed lighting trim retention system of claim 1, wherein the first complementary toggle means includes a V-spring and the second complementary toggle means includes a cross-member formed into the second stationary portion.

4. The recessed lighting trim retention system of claim 1, wherein the first complementary toggle means includes a hump formed in the first stationary portion, and the second complementary toggle means includes ridge formed in the mounting bracket.

5. The recessed lighting trim retention system of claim 1, wherein the first complementary toggle means includes a V-spring, and the second complementary toggle means includes a cross-member formed into the second stationary portion.

6. The recessed lighting trim retention system of claim 2, wherein the V-spring includes a steel bar spring with a peak along its length.

7. The recessed lighting trim retention system of claim 1, wherein the first and secondary portions are discrete components that are joined together.

8. The recessed lighting trim retention system of claim 1, wherein the friction blade includes a stopper tab along a bottom edge thereof.

9. The recessed lighting trim retention system of claim 1, wherein the second stationary portion includes a channel to form the vertical space.

10. A recessed lighting trim retention system for supporting a light fixture inside a can, comprising:

at least two friction blade trim attachments, each attachment including:

a first stationary portion having a horizontally elongated shape with resilient spring arms at opposite ends, wherein each spring arm terminates in a friction blade having an edge for engaging an interior of the can;

a second stationary portion including a channel disposed on the first stationary portion, wherein the channel forms a vertical space between the first and second stationary portions;

an elongated L-shaped mounting bracket translating vertically relative to the first stationary portion within the vertical space, wherein the mounting bracket includes a spring biased toggle means facing the vertical space, the elongated mounting bracket attached to the light fixture;

a complementary toggle means facing the spring biased toggle means, wherein the complementary toggle means is disposed on one of the elongated mounting bracket and the second stationary portion; and wherein the spring biased toggle means and the complementary toggle means selectively engage each other to bias the elongated mounting bracket into one of an up position and a down position of the light fixture relative to the can.

11. The recessed lighting trim retention system of claim 10, wherein the system includes a center bracket mounted to the light fixture and interconnecting the at least two friction blade trim attachments.

12. The recessed lighting trim retention system of claim 10, wherein the spring biased toggle means includes at least one of a V-spring, a ridge, and a protrusion.

13. The recessed lighting trim retention system of claim 10, wherein the complementary toggle means includes at least one of a V-spring attached to the second stationary portion, and a cross-member formed into the second stationary portion.

14. A recessed lighting trim retention system for supporting a light fixture inside a can, comprising:

a first stationary portion having an elongated, flat sheet shape with opposed resilient spring arms each terminating in a friction blade having an edge for engaging an interior of the can;

a second stationary portion disposed on the first stationary portion to form a vertical space therebetween;

an elongated mounting bracket sliding vertically relative to the first and second stationary portions within the vertical space, wherein the elongated mounting bracket is attached to the light fixture;

first and second complementary toggle means disposed on the elongated mounting bracket and the second stationary portion, respectively; and wherein the first and second complementary toggle means selectively engage each other to bias the elongated mounting bracket into one of an up position and a down position of the light fixture relative to the can.

15. The recessed lighting trim retention system of claim 14, wherein the first complementary toggle means includes at least one of a V-spring, a ridge, a finger, and a protrusion.

16. The recessed lighting trim retention system of claim 14, wherein the second complementary toggle means includes at least one of a V-spring joined to the second stationary portion, and a cross-member formed into the second stationary portion.

* * * * *